US007703254B2

(12) United States Patent
Alderman

(10) Patent No.: US 7,703,254 B2
(45) Date of Patent: Apr. 27, 2010

(54) REFLECTIVE INSULATION TILES

(76) Inventor: Robert J. Alderman, 218 Anglers Dr., Marathon, FL (US) 33050

( * ) Notice: Subject to any disclaimer, the term of this patent is extended or adjusted under 35 U.S.C. 154(b) by 0 days.

(21) Appl. No.: 12/099,338

(22) Filed: Apr. 8, 2008

(65) Prior Publication Data

US 2008/0282637 A1 Nov. 20, 2008

Related U.S. Application Data

(60) Provisional application No. 60/978,432, filed on Oct. 9, 2007.

(51) Int. Cl.
*E04B 1/78* (2006.01)
*E04B 9/00* (2006.01)

(52) U.S. Cl. ..... 52/506.07; 52/407.2; 52/407.3; 52/407.5; 52/795.1; 428/68; 428/72; 428/76

(58) Field of Classification Search ..... 52/19, 52/202, 406.1–406.3, 407.1–407.3, 407.5, 52/506.01, 506.06, 506.07, 664–668, 783.1, 52/408, 795.1, 794.1; 165/10; 428/68–76
See application file for complete search history.

(56) References Cited

U.S. PATENT DOCUMENTS

| | | | | |
|---|---|---|---|---|
| 1,522,708 | A * | 1/1925 | Andrews | 52/406.3 |
| 2,148,496 | A * | 2/1939 | Park | 181/290 |
| 2,791,681 | A * | 5/1957 | Evans | 362/374 |
| 4,290,247 | A * | 9/1981 | Alderman | 52/302.3 |
| 4,642,951 | A * | 2/1987 | Mortimer | 52/145 |
| 4,977,711 | A * | 12/1990 | Prignitz | 52/309.8 |
| 5,376,424 | A * | 12/1994 | Watanabe | 428/69 |
| 5,626,936 | A * | 5/1997 | Alderman | 428/68 |
| 5,732,521 | A * | 3/1998 | Schmitt-Raiser | 52/506.07 |
| 5,770,295 | A * | 6/1998 | Alderman | 428/68 |
| 5,845,459 | A * | 12/1998 | Nathan | 52/788.1 |
| 6,037,033 | A * | 3/2000 | Hunter | 428/72 |
| 6,397,531 | B1 * | 6/2002 | Martin | 52/220.6 |
| 6,481,173 | B1 * | 11/2002 | Roy et al. | 52/506.07 |
| 6,557,313 | B1 | 5/2003 | Alderman | |
| 6,645,598 | B2 | 11/2003 | Alderman | |
| 6,811,852 | B2 | 11/2004 | Alderman | |
| 6,857,238 | B2 | 2/2005 | Alderman | |
| 2003/0031776 | A1 * | 2/2003 | Thresher | 426/578 |
| 2004/0163345 | A1 * | 8/2004 | Alderman | 52/404.1 |

FOREIGN PATENT DOCUMENTS

| | | | |
|---|---|---|---|
| DE | 10 2006 029 597 | A1 * | 1/2007 |
| GB | 2125081 | A * | 2/1984 |
| WO | 2007/039221 | A1 * | 4/2007 |

* cited by examiner

*Primary Examiner*—Robert J Canfield
(74) *Attorney, Agent, or Firm*—Thomas, Kayden, Horstemeyer & Risley, LLP

(57) ABSTRACT

Heat insulation tiles (20) are supported in a grid (14) of support bars (15 and 16) of a ceiling assembly (10) with the ceiling tiles being in the form of insulation boxes (21) that form a dead air spaces (24) therein. Reflective material (22) is applied to at least one of the interior surfaces of the box that faces the dead air space (24) and a layer of phase change material (40) is applied to the insulation boxes.

29 Claims, 5 Drawing Sheets

REFLECTIVE INSULATION TILES

CROSS REFERENCE TO RELATED APPLICATION

This application claims the benefit of U.S. Provisional Application 60/978,732 filed in the U.S. Patent and Trademark Office on Oct. 9, 2007.

FIELD OF THE INVENTION

This invention generally concerns insulation for structural buildings, particularly reflective insulation and other insulations suitable for use in ceiling structures of buildings.

BACKGROUND OF THE INVENTION

A typical structured ceiling structure in dwellings usually includes wall board such as gypsum board attached to the bottom surfaces of higher structures, such as joists that support a floor or an attic above the joists. In structures where the floor above is an attic or other space generally open to the atmosphere, insulation such as blown or bats of fiberglass, mineral wool, cellulose or other low heat transmittal materials are placed on top of the ceiling surfaces and between the joists to reduce the transfer of heat through the ceiling.

Another common ceiling structure is a suspended ceiling usually found in less formal structures such as industrial or commercial buildings. Suspended ceilings usually comprise a grid of support bars that form an array of rectangular openings, with the support bars suspended by wires, etc. from an overhead structure. Ceiling tiles of the size and shape suitable for spanning the openings are laid on the support bars so that the bottom surfaces of the support bars and the bottom surfaces of the ceiling tiles form an attractive interior ceiling assembly. Insulation as described above may be placed on the upwardly facing surfaces to the suspended ceiling.

An important feature of some ceiling structures is the insulation value of the materials in the ceiling structure, particularly for those ceilings that are directly below an attic or other space that is in free communication with the outside atmosphere. This is because the outside temperature may be higher or lower than the moderate temperature in the dwelling space below, and it is desirable that the moderate inside temperature remain within a narrow range that is suitable for comfortable habitation by the occupants of the rooms below.

This invention generally concerns improvements in heat insulation of structural buildings and other structures. For example, reflective heat insulation may be in the form of boxes used as tiles in structures such as ceilings of structural buildings. In one form of the invention phase change material may be used in combination with heat reflective material. Insulation tiles that embody these features may be mounted to an existing ceiling structure, or the insulation tiles may be used to form the ceiling structure, or the tiles may be used to construct a suspended ceiling. The insulation tiles may be used in the attic of a building structure by placing the tiles between joists and rafters, or by mounting to purlins and other structures.

In general, there appears to be a need for improved heat insulation for ceiling structures of buildings, with the insulation having its own permanent and improved heat insulation features integrated therein, and that reduce the need for afterapplied insulation, such as fiberglass bats, etc. It is to these endeavors that this invention is directed.

SUMMARY OF THE INVENTION

Briefly described, the structures described herein concern ready made heat insulation tiles that may be used to form insulated structures, including, for example, either structural ceilings or suspended ceilings, with the tiles including their own improved internal heat insulation features.

In one embodiment, the structure formed with the heat insulation tiles is a structured ceiling that is formed against an overhead structural part of a building, such as the joists or wall board that form the upper portion of the rooms of the building. For example, the heat insulation tiles may be attached to an existing ceiling surface or to the joists above by mounting furring strips in parallel spaced relationship on the overhead structure to form a support grid, and attaching the ceiling tiles at their edges to the furring strips to occupy the openings in the grid.

Another embodiment of a structure that may be formed with the heat insulated tiles is a suspended ceiling. The suspended ceiling includes a support grid of suspended support bars defining an array of openings therethrough. The heat insulation tiles are supported on the grid and occupy the array of openings.

Another use for the heat insulation tiles is to place them on the existing insulation in an attic of a building.

In these examples the heat insulation tiles may include heat reflective material, and phase change material, or both. The same or similar insulation tiles may be used in other environments, as may be desired.

The heat insulation boxes may define an interior dead air space usually greater than one-half inch in depth, up to effectively six inches in depth, and reflective material is positioned in the interior space of the box, usually on the bottom wall and/or the top wall of the box, with a reflective surface of the material facing the dead air space in the box. The reflective material may comprise reflective sheet material, such as aluminum foil, but other reflective material in sheet form or in other forms may be used.

The ceiling tile may comprise an insulation box with heat reflective inside surfaces forming an interior "dead air" space, and of a breadth and configuration to occupy an opening of the support grid and to be supported by the grid. A layer of phase change material may be positioned inside the heat insulation box or may be otherwise supported by the heat insulation box.

The insulation box may include a protrusion or flange extending outwardly from the perimeter walls for supporting the box. For example, the protrusions may be attachable to furring strips of a structured building or engage the support bars of the grid in a suspended ceiling.

The insulation box may include a lid that is sized and configured to rest on the perimeter walls of the insulation box and close the interior space of the insulation box, with reflection material mounted to the inside surface of the lid and/or to other surfaces of the box. The lid of the insulation box may be hingedly attached to a perimeter wall of the box and sized and configured to rest on the perimeter wall and to close the interior space of the insulation box.

Phase change material may be included in the interior space of the heat insulating box, or on top of the insulation box. For example, the phase change material may be supplied in the form of sheets of bubble pack material, with the phase change material occupying the bubbles of the sheet of bubble pack material.

The insulation box may be shaped to nest with duplicate insulation boxes, whereby the insulation boxes may be accumulated in nested configuration for shipment to a job site, etc. If the insulation boxes have lids, the boxes may be nested by opening the lids and nesting both the lids and the boxes.

The insulation boxes may be formed of a material selected from: molded polystyrene, molded cellulose pulp, cardboard, vinyl, metal, EPS, wood, and other heat insulation materials that are durable, light weight, mildew resistant, and strong enough to maintain their structural shapes in the environment of the building structure.

DETAILED DESCRIPTION

Figure 1:
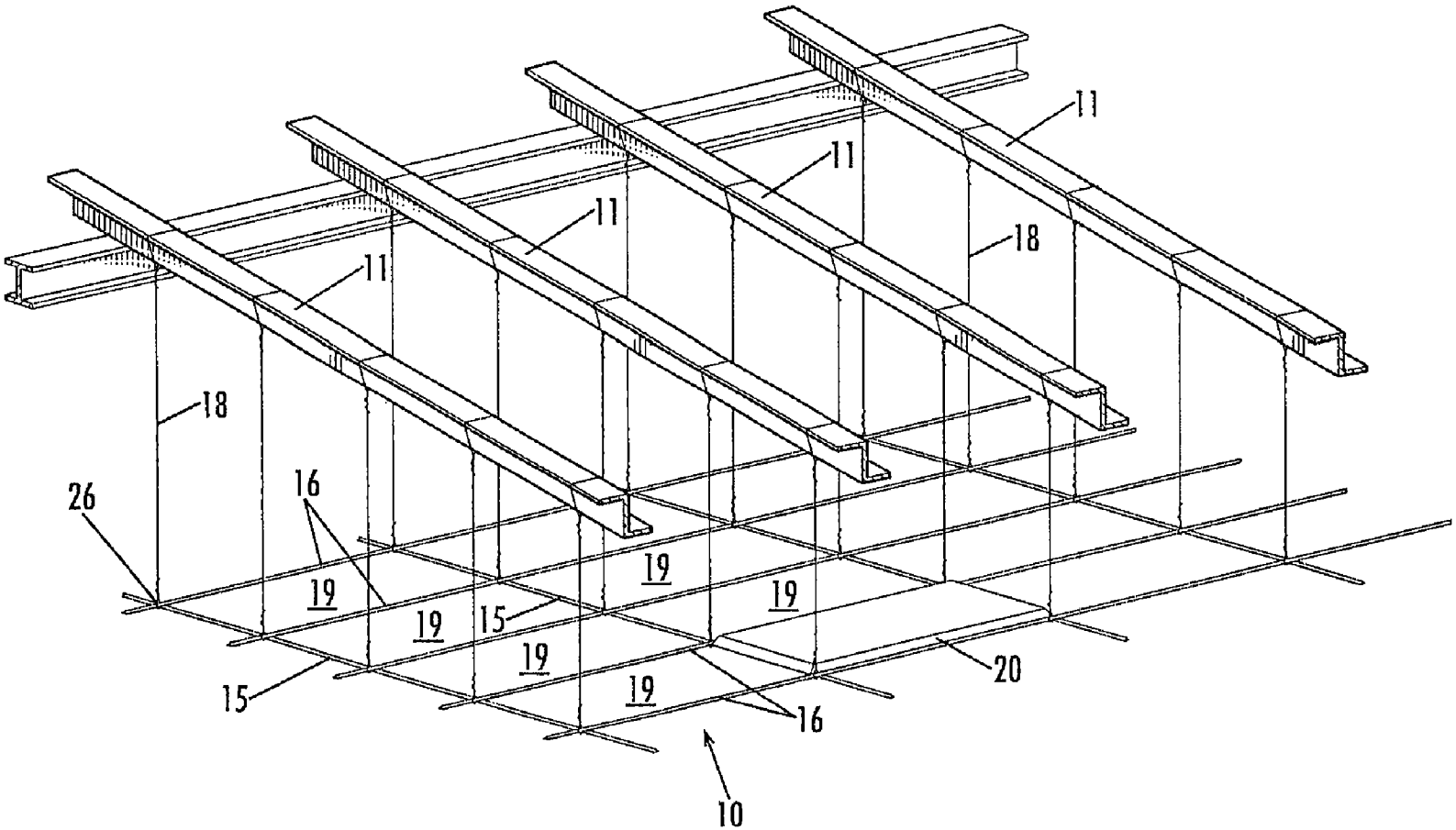
Fig. 1 Prior Art
FIG. 1 is a perspective illustration of a grid of support bars that form openings therethrough for suspending from an overhead structure of an industrial building, such as from purlins of the building.

Referring now in more detail to the drawings, FIG. 1 illustrates a partially completed suspended ceiling assembly 10 which is hung from purlins 11 of a building structure. The suspended ceiling assembly comprises a support grid 14 formed from crossing support bars 15 and 16, suspension means such as wires 18 connected at their lower ends to the support bars and at their upper ends to purlins 11 or other overhead structures. Generally, it is desirable that the support bars 15 and 16 are horizontally oriented.

Figure 2:
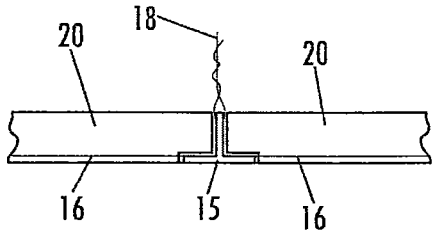
FIG. 2 is a detail view of the intersection of the support bars and the box insulation applied thereto.

As shown in FIG. 2, the support bars 15 and 16 may be T-shaped in cross section and are hung so that they are in an inverted T shape, with openings through the stem of the T that receive the wires 18.

The grid 14 of support bars 15 and 16 form an array of openings 19. Ceiling tiles, such as ceiling tiles 20 of FIGS. 1-9, occupy the openings 19 of the support grid 14 formed by the suspended support bars.

Figure 3:
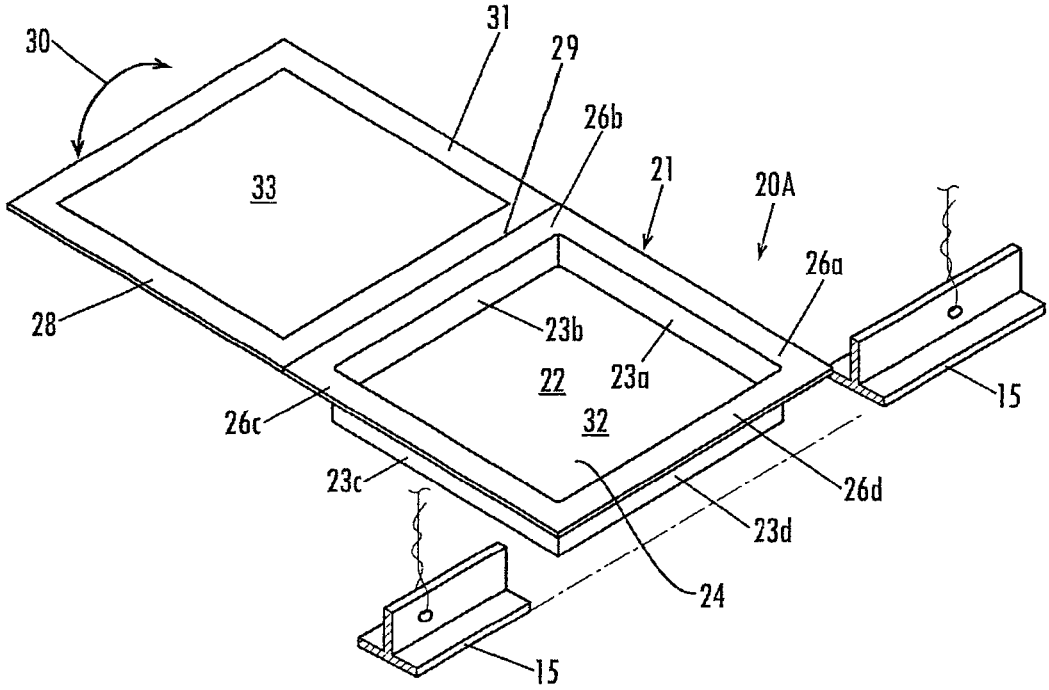
FIG. 3 is a perspective view of an insulation box having a lid hingedly connected thereto, showing how the flanges of the box may be used to support the boxes.

As shown in FIG. 3, one embodiment of the ceiling tiles is ceiling tile 20*a* that is formed in a rectangular configuration in the form of a heat insulation box 21 having a bottom wall 22 and perimeter walls 23*a*, 23*b*, 23*c* and 23*d*. The bottom wall and perimeter walls form an interior space 24 above the bottom wall. Protrusions extend from the perimeter walls at a level higher than bottom wall 22. The protrusions may be in the form of a continuous flange having segments 26*a*, 26*b*, 26*c* and 26*d* that extend from the upper portions of the perimeter walls 23*a*-23*d*, respectively. A lid or top 28 may be attached to the outer edge of flange 26*b* by a hinge 29 so that the lid 28 can pivot as indicated by arrow 30 between open and closed positions with respect to the perimeter walls 23*a*-*d* and flanges 26*a*-*d*. When the lid is closed this forms a closed interior space 24 that is a dead air space. Preferably, the vertical dimension of the interior space 24 is between one-half inch and six inches. However, other sized spaces may be used that provide the depth of dead air needed to provide the desired insulation R factor.

A layer of reflective material 32 is applied to the inside surface of the bottom wall 22. The reflective material may be a sheet of aluminum foil, a reflective coating applied to the inner surfaces of the box, or other preferably highly heat reflective, inexpensive material. Optionally, the layer of reflective material may be adhesively applied to the bottom wall, if desired. Other attachment means may be used as desired. The reflective material 32 has a reflective surface that faces the dead air space 24 of the insulation box.

The lid 28 may be closed over the box 21 so as to form the dead air space 24 and enclose and protect the layer of reflective material 32 from accumulation of dust or other objects, thereby preserving the reflectivity of the reflective material 32. However, it is possible that the lid 28 may be omitted from the box, with it being understood that the interior of the box will abut some other surface or there will be some other means that will close about the interior of the box to form a dead air interior space 24 adjacent the reflective material 32 and avoid or at least reduce the infiltration of dust, etc. on the reflective material.

The bottom walls 22 of the boxes 20, 21 of FIGS. 3-7 may be recessed downwardly from the protrusions or flanges 26*a*-26*d*, and the perimeter walls 23*a*-23*d* are configured so that the perimeter walls may be passed through the openings 19 of the support lattice or grid 14, while the flanges 26*a*-26*d* come to rest on the sides of the crossheads of the inverted T shapes of the support bars 15 and 16. This suspends the recessed portion of the insulation boxes below the plane of the grid 14 and also presents the dead air space 24 over a reflective sheet 32 suspended downwardly from the support bars 15 of the grid.

A second layer of reflective material 33 may be applied to the inside surface 31 of lid 28. A reflective surface of the second layer of reflective material faces the dead air space between the lid 28 and the first layer of reflective material 32 that may be applied to bottom wall 22. Reflective material also may be applied to the sides and ends of the insulation boxes if desired.

Figure 4:
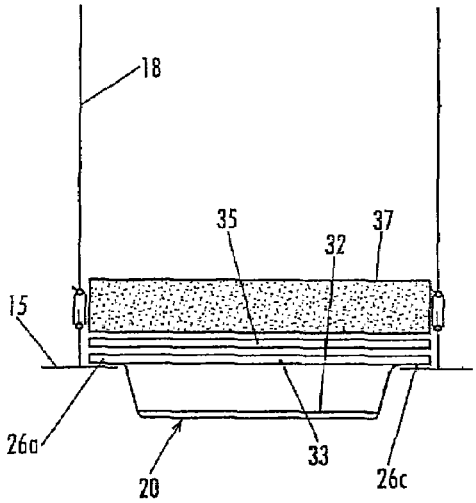
FIGS. 4, 5, 6, 7, 8 and 9 are end views of different configurations of the ceiling tiles and how they are supported on the grid formed by the suspended support bars.
Figure 5:
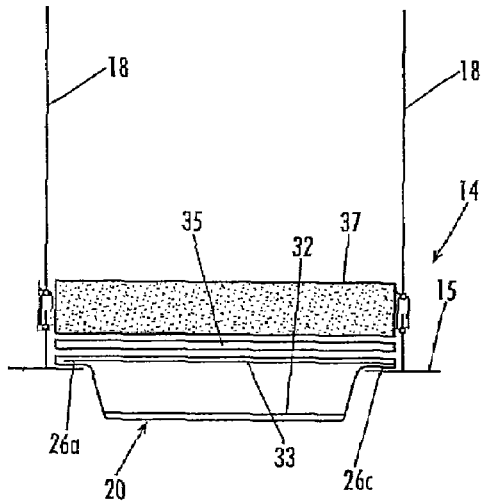

The ceiling tiles 20 of FIG. 3 are shown in side elevational view in FIGS. 4 and 5, where the flanges 26*a* and 26*c* can be seen resting on the crosshead of the inverted T shape support bars 15.

Figure 6:
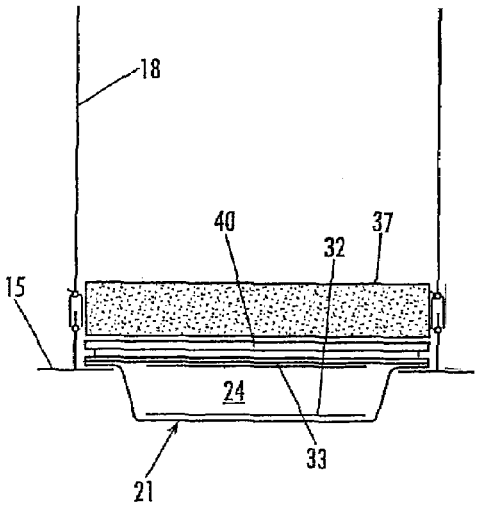
Figure 7:
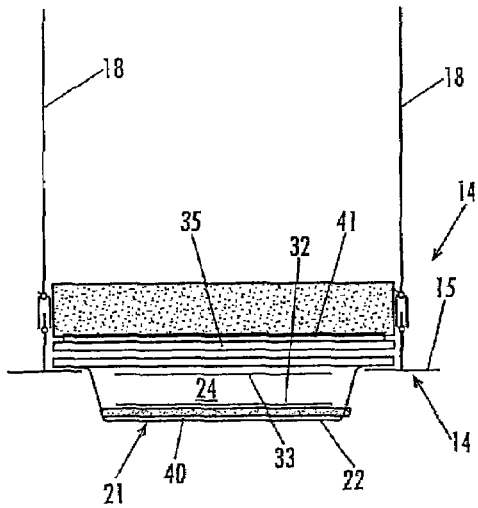

FIG. 4 shows a possible retrofit of a previously installed suspended tile ceiling structure. The original ceiling tiles 35 were removed so that the reflective insulation ceiling tile 20 could be installed on the support grid 14 of inverted T bars 15. Once the reflective insulation ceiling tiles 20 have been properly installed, the original ceiling tiles 35 can be laid on top of the reflective insulation ceiling tiles 20 as shown in FIGS. 6 and 7. Optionally, insulation material 37, such as blown or mats of fiberglass, mineral wool, cellulose, etc. may be applied over the original ceiling tiles 35. Another option is that the original ceiling tiles 35 may be omitted and insulation batts can be applied directly to the insulation box 21.

Figure 14:
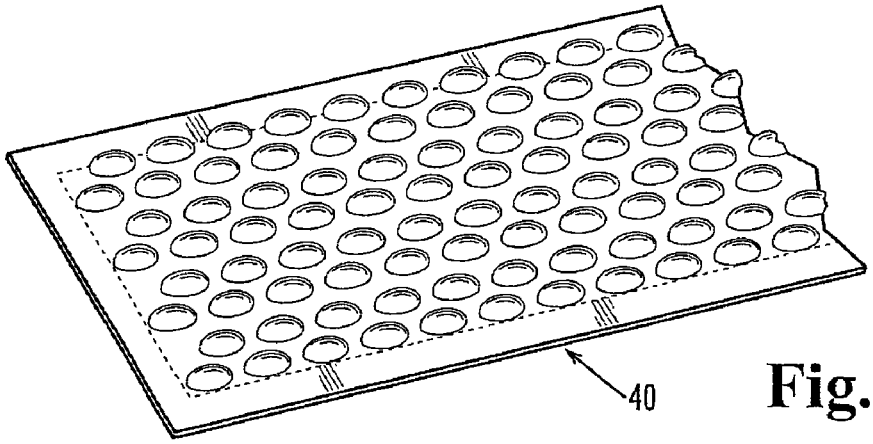
Fig. 14 Prior Art
FIG. 14 is a perspective view of a phase change bubble pack that may be used in the heat insulation box.

Other embodiments of the reflective insulation ceiling tiles is shown in FIGS. 6 and 7. The insulation box 21 is installed as previously described, having layers of reflective material 32 and 33 applied to at least one of its facing interior surfaces on opposite sides of a dead air space 24, and a layer of phase change material ("PCM") is applied over the lid of the box. The phase change material may be provided in the form of a bubble pack 40 as shown in FIG. 14, similar to the PCM as disclosed in U.S. Pat. Nos. 5,626,936 (see FIGS. 5 and 6, Col. 3 and 4, lines 37-67) and 6,645,598 (See FIGS. 1-8 and Col. 5 and 6, lines 44-63). Applicant hereby incorporates herein these patents in their entirety and specifically the designated portions thereof. The PCM may be formed in a bubble pack of two layers of material, with the internal space formed by the bubbles between the layers filled with PCM. The PCM may be chosen so that it tends to change phase between solid and liquid compatible with the desired room temperature of the space below the suspended ceiling structure. Typically the phase change material will be selected from materials that change between solid and liquid in a temperature range between about 60° F. and about 95° F. Some examples of phase change materials for isothermally storing and releasing heat essentially are paraffin, calcium chloride hexahydrate, and Glauber's salt. Other materials may be added to these materials as may be desired. By providing the phase change material in closed bubbles of the bubble pack 40, there is little hazard of the phase change material leaking or running from the bubble pack when in its liquid form. Also, the phase change material tends to remain substantially evenly distributed over the width and length of the bubble pack sheet. Optionally, the bubble pack sheet 40 would be formed in a length and width that corresponds to the length and width of the insulation box 21. As an alternative, some PCM's, such as paraffin, may be soaked directly into the ceiling tile if the ceiling tile is absorptive. Other means of supporting the PCM may be used.

As shown in FIG. 7, the PCM 40 may be applied in between different layers of the structure. For example, the PCM may be applied on the bottom wall 22 of the insulation box 21, or the PCM layer 41 may be applied on top of the box, with or without the original ceiling tile 35 interposed between the PCM layer 41 and the upper surface of the insulation box 21. The layers of reflective material 32 and 33 are applied so that they face the dead air space 24 in the insulation box 21, with the reflective material 32 applied over the PCM 40.

FIGS. 6 and 7 show another alternative for a suspended ceiling structure in that an insulation batt 37 may be applied over the insulation box in FIG. 6 and with the insulation batt 37 applied over the PCM layer 41 of FIG. 7.

Figure 8:
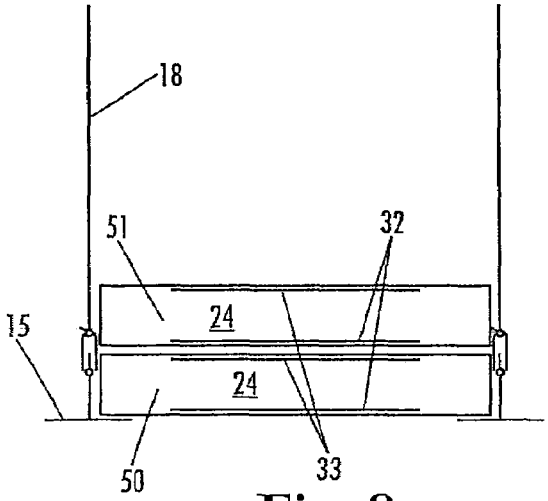
Figure 9:
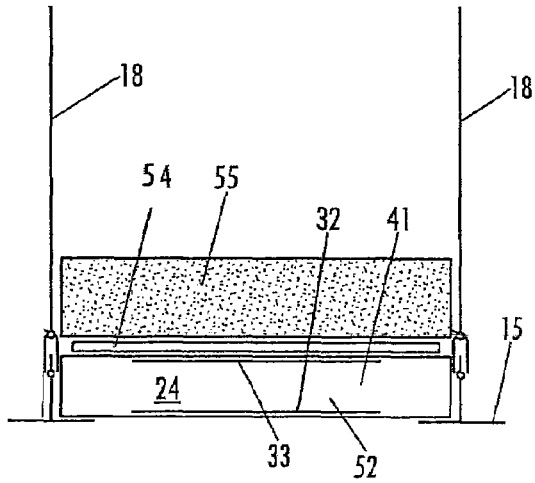

While FIGS. 3-7 show insulation boxes 21 with recessed bottom walls that are sized and shaped to form the dead air spaces and to extend below support lattice of grid 14, FIGS. 8 and 9 illustrate insulation boxes 50, 51 and 52 that are of conventional rectangular shape with bottom walls that are not reduced in breadth or recessed to fit between the bars of the suspended grid, and which are of a configuration and size to rest on the support bars 15 and to occupy the openings 19 of the grid 14. The insulation boxes 50-52 enclose a dead air space of suitable depth for the desired insulation characteristics with layers of reflective material, such as sheet aluminum 32 and 33, applied to either or both of the opposed bottom and top walls thereof, facing the adjacent dead air space 24.

As shown in FIG. 8, more than one insulation box may occupy the openings of the support grid 14, if desired. As shown in FIG. 9, the insulation boxes, such as box 52, may be combined with a PCM layer 54 and a batt 55 of insulation material such as fiberglass, mineral wool, etc.

Figure 10:
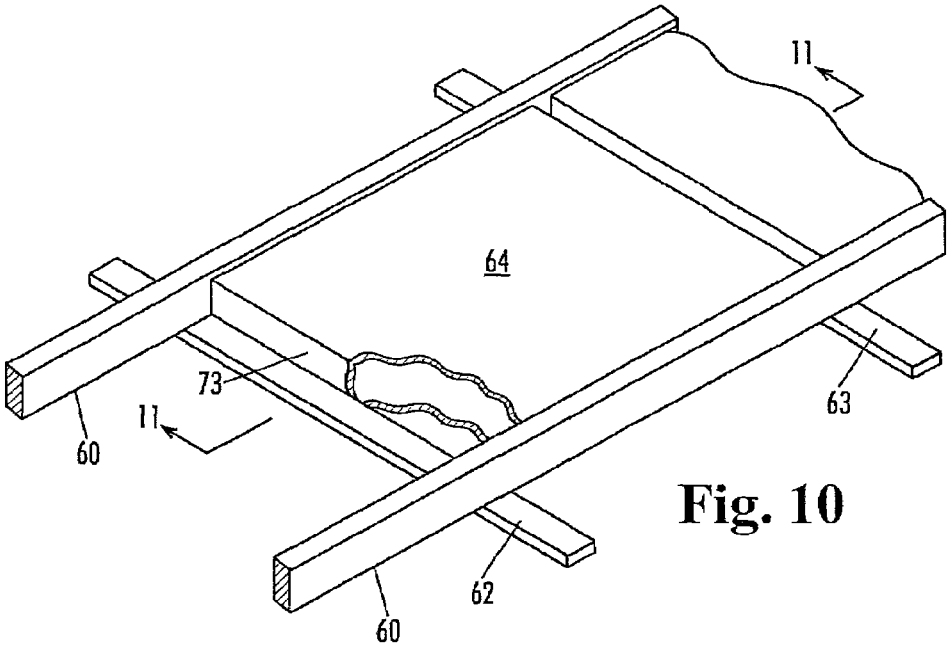
FIG. 10 is a perspective view of a partially completed structural ceiling, showing how furring strips may be used to mount the ceiling tiles to the ceiling of the structure.
Figure 11:
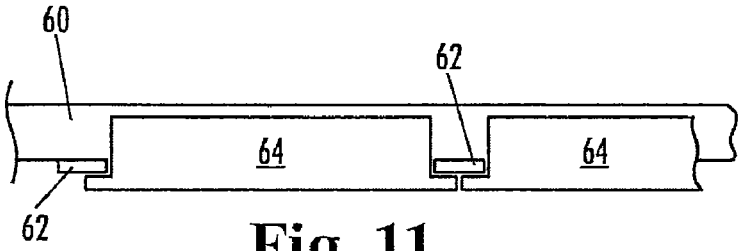
FIG. 11 is an end cross sectional view of a portion of the ceiling structure of FIG. 10, taken along lines 11-11 of FIG. 10
Figure 12:
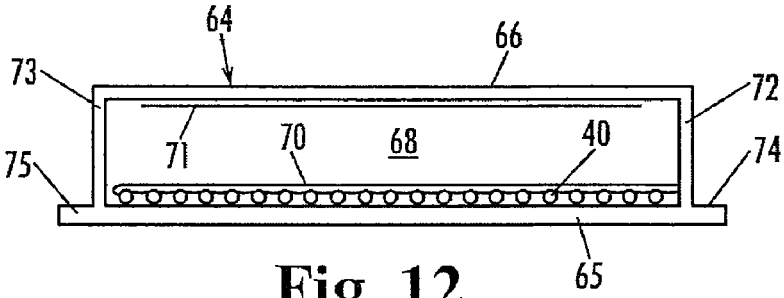
FIG. 12 is a more detailed illustration of the heat insulation box.

FIGS. 10-12 disclose how an insulated ceiling box may be mounted to a structural ceiling (as opposed to a suspended ceiling). As shown in FIG. 10, a ceiling structure may be formed of joists 60 arranged in parallel spaced relationship, usually in a horizontal plane. In this illustration, no wall board is shown attached to the joists. However, it would be understood that wall board may be applied to the bottom surfaces of the joists to form the structural ceiling.

A plurality of furring strips 62, 63 are attached by fasteners (not shown) to the bottom surfaces of the joists 60. The furring strips are arranged parallel to one another and perpendicular to the joists. The furring strips 62 and joists 60 form a support grid with an array of openings formed thereby. Heat insulation tiles in the form of insulation boxes 64 are placed in the openings of the support grid, as shown in FIGS. 10 and 11. The heat insulation boxes are similar to those of FIGS. 1-9, with appropriate changes in shape and size to be accommodated by the ceiling structure.

As with the heat insulation boxes of FIGS. 1-9, the heat insulation boxes 64 of FIG. 10-13 include bottom and top walls 65 and 66 that are spaced apart to form a dead air space 68, as previously described. As shown in FIG. 12, phase change material 40 may be applied to the bottom wall 65, and heat reflective material such as reflective sheets may be placed in the box, with the reflective sheet 70 placed over the PCM 40 and with the reflective sheet 71 supported by the top wall 66. The reflective sheets 70 and 71 have reflective surfaces that face a dead air space 68.

Figure 13:
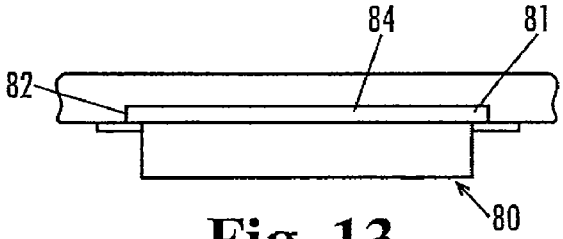
FIG. 13 is an end view of a modified heat insulation box installed in a structural ceiling.

The heat insulation boxes 64 of FIGS. 10-12 may have protrusions extending outwardly from the perimeter walls 72 and 73. In this example, the protrusions may be in the form of perimeter flanges, such as flanges 74 and 75 that are in the same plane as the bottom wall 65 of the heat insulation box. The protrusions 74 and 75 may be used to fasten the insulation boxes to the furring strips 62. If desired, the protrusions 74 and 75 may be positioned at other positions along the perimeter walls 72 and 73 so that the heat insulation box 64 may be suspended downwardly into the space of the room below, without protruding above the level of the furring strips. For example, FIG. 13 shows a heat insulation box 80 that has its protrusions 81 and 81 that are located at the level of the top wall 84.

The upper wall 64 of FIG. 12 may be formed as a lid that closes the heat insulation box, as previously described, to form the dead air space, or other means may be used to close the box and maintain the dead air space substantially dust free.

Since the reflective material, such as reflective materials 32, 33 of FIGS. 8 and 9 and the reflective material 70 and 71 of FIG. 12, are maintained in a closed box or similar closed structure, the accumulation of dust and other debris is generally avoided. This maintains the reflectivity of the layers of reflective material. The reflectivity of the reflective material and the adjacent suitable depth dead air space has the effect of applying an insulation value of approximately R-12 to the suspended ceiling structure when the heat flow is down and an insulation value of approximately R-2 when the heat flow is up.

As shown in FIGS. 7 and 12, when the PCM 40 is in the lower portion of the insulation box 21 or 64 and the hotter daylight time comes, the outside temperature may rise above the phase change temperature of the PCM. The heat from the outside environment must pass through the walls of the box, through the dead air space 24 or 68 inside the box and through at least one of the reflective materials 33, 32 or 70, 71 on the internal wall surfaces of the box to reach the solid PCM. The PCM begins to absorb the heat from the outside environment and eventually reaches its phase change temperature. When in its phase change temperature, the PCM will continue to absorb heat from the warmer outside environment but the PCM remains at its phase change temperature as it absorbs heat that is used to change the phase of the PCM from a solid to a liquid. This delays the transmission of heat from the warmer outside environment to the inside of a dwelling until the PCM has changed from its solid state to its liquid state.

A heat insulation box having both heat reflective material and PCM as shown in the structure of FIGS. 7 and 12 may have, for example, three inches of vertical height of dead air space with the PCM in the bottom of the box. This typically yields about an R=9.15 for E-0.03 when heat flow is downward. It is only about R=2 when the heat flow is up. This difference in R-value is caused by convection heat transfer. Because of this difference in R-value, the heat insulation box loses heat faster during colder night hours than it gains heat during the hot daylight hours. The PCM solidifies faster during the cooler night hours and liquefies slower in the hot daylight hours.

This relationship is particularly favorable for refreezing the PCM in the night hours during the summer months. At night when the heat flow is upward, the reflective dead air space is approximately R=2, whereas the higher rating R=9 is present during the day when the heat flow is in a downward direction. The higher R=9 rating tends to protect the PCM from melting too soon during the day when the heat flow is down. However, in summer, it is desirable to have the PCM solidify at a faster rate during the darkness hours.

The function of PCM as an insulator is explained in more detail in U.S. Pat. Nos. 5,626,936 and 6,645,598. Reflective heat insulation is disclosed in more detail in U.S. Pat. Nos. 6,557,313 (see FIG. 2 and col. 4-5, lines 43-10), 6,811,852 (see FIG. 1, Col. 5, lines 11-50), and 6,857,238. The disclosures of these patents are incorporated herein by reference.

While the heat insulated tiles have been described in the form of heat insulation boxes, other forms of the tiles may be used that may be compatible with the surrounding structure, and the tiles may be used for structures other than ceilings. The boxes of the tiles may be made in a form that allows them to collapse and occupy less space when in storage or in transport, as by folding the perimeter walls.

Although preferred embodiments of the invention have been disclosed in detail herein, it will be obvious to those skilled in the art that variations and modifications of the disclosed embodiments can be made without departing from the spirit and scope of the invention as set forth in the following claims.

The invention claimed is:

1. A ceiling tile for mounting in a support grid and forming a heat insulated ceiling comprising:

a heat insulation box including walls forming a dead air interior space of between about ½ inch and about 6 inches in height, a layer of phase change material positioned in said insulation box and configured to change phases in response to heat applied to said phase change material, and a layer of heat reflective material disposed within the insulation box with a reflective surface facing the dead air interior space for reflecting heat toward said empty dead air interior space.

2. The ceiling tile of claim 1, wherein said dead air interior space is configured for having a heat insulation value that is greater when the heat flow is downward than when the heat flow is upward.

3. The ceiling tile of claim 1, and further including a protrusion extending about said heat insulation box for supporting the ceiling tile in the support grid.

4. The ceiling tile of claim 1, wherein the insulation box includes a lid sized and configured to rest on the heat insulation box and close the said dead air interior space of the insulation box, and the reflective material mounted to the inside surface of the lid and facing said dead air interior space.

5. The ceiling tile of claim 1, wherein said heat insulation box includes a top wall extending over said dead air interior space, said layer of phase change material is positioned on said top wall, and a layer of heat insulation material is positioned on said phase change material.

6. A ceiling tile for mounting in a support grid and forming a heat insulated ceiling comprising:

a heat insulation box including walls forming a dead air interior space, a layer of heat reflective material disposed within the insulation box with a reflective surface facing the dead air interior space for reflecting heat toward said dead air interior space, and a layer of phase change material supported by said insulation box and configured to change phases in response to heat applied to said phase change material, said heat insulation box includes a bottom wall, and said layer of phase change material is positioned at said bottom wall of said insulation box and said layer of heat reflective material is positioned above said phase change material, such that when the heat flow is downward the insulation value of the ceiling tile is greater than when the heat flow is upward.

7. The ceiling tile of claim 6, wherein the phase change material is selected from materials that change between solid and liquid in a temperature range between about 60° F. and about 95° F.

8. The ceiling tile of claim 7 wherein said phase change material is positioned in said dead air interior space of said box.

9. A ceiling tile for mounting in a support grid and forming a heat insulated ceiling comprising:

a heat insulation box including walls forming a dead air interior space, a layer of phase change material positioned in said insulation box and configured to change phases in response to heat applied to said phase change material, said layer of phase change material comprising a sheet having an array of bubbles and material in the bubbles formed of phase change material, and a layer of heat reflective material disposed within the insulation box with a reflective surface facing the dead air interior space for reflecting heat toward said dead air interior space.

10. The ceiling tile of claim 9, wherein the ceiling tile is constructed so that the rate of heat exchange through the ceiling tile is greater when the heat flow is upward than when downward.

11. A ceiling tile for mounting in a support grid and forming a heat insulated ceiling comprising:

a heat insulation box including walls forming a dead air interior space, a layer of phase change material positioned in said insulation box and configured to change phases in response to heat applied to said phase change material, and a layer of heat reflective material disposed within the insulation box with a reflective surface facing the dead air interior space for reflecting heat toward said dead air interior space, and wherein when the insulation box is open, the insulation box is shaped to nest with duplicate insulation boxes, with the reflective material and the phase change material supported in the open insulation box.

12. The ceiling tile of claim 11, wherein the insulation box is formed of a material selected from: molded polystyrene, molded cellulose pulp, cardboard, vinyl, metal, EPS, and wood.

13. An insulated ceiling of a building structure positioned between a moderated temperature area and an adjacent area of temperatures that become higher and lower than the temperature of the moderated temperature area, comprising:

a support grid defining an array of openings therethrough, heat insulation structures supported on said support grid and occupying the array of openings, the heat insulation structures each defining a dead air space greater than ½ inch high said heat insulation structures each including phase change material positioned in said dead air space and configured to change phases in response to heat applied to said phase change material, and heat reflective material in said dead air space positioned on the side of said dead air space adjacent the moderated temperature area and facing said dead air space, such that heat passing through the heat insulation structure is reflected by the heat reflective material and tends to change the phase change material to another phase.

14. The ceiling structure of claim 13, wherein the phase change material is selected from materials that change between solid and liquid in a temperature range between about 60° F. and about 95° F.

15. The ceiling structure of claim 13, wherein the heat insulation structures each comprise individual structures that fit the openings of the array of openings.

16. The ceiling structure of claim 13, wherein the heat insulation structures comprise heat insulation boxes.

17. The ceiling structure of claim 16, wherein the layer of phase change material is positioned in the heat insulation box.

18. The ceiling structure of claim 13 wherein the reflective material comprises aluminum foil having a reflective surface facing the dead air space and the aluminum foil is positioned above said phase change material.

19. A heat insulation tile for mounting to ceilings of building structures, said heat insulation tile comprising a heat insulation box having interior surfaces, the interior surfaces including a bottom wall and perimeter walls defining a dead air space, a layer of phase change material positioned on said bottom wall, and heat reflective material applied to at least one of the interior surfaces and facing said dead air space.

20. The heat insulation tile of claim 19, wherein the phase change material is positioned in the box.

21. The heat insulation tile of claim 19, wherein the phase change material is selected from the group consisting essentially of: paraffin, calcium chloride hexahydrate, and Glauber's salt.

22. The heat insulation tile of claim 19, wherein the phase change material is in the form of a bubble pack that includes phase change material in the bubbles.

23. The heat insulation tile of claim 19, wherein the phase change material rests on a bottom wall of the heat insulation boxes and said heat reflective material comprises a layer of heat reflective sheet material positioned on said phase change material.

24. The heat insulation tile of claim 19, wherein the phase change material selected from materials that change between solid and liquid in a temperature range between 60 degrees and 90 degrees F.

25. A heat insulation tile configured for mounting to ceilings of building structures comprising a heat insulation box defining bottom surface and a dead air space above the bottom surface of at least ½ inch high, a phase change material supported at the bottom surface by the heat insulation box, a heat reflective material in said box positioned above the phase change material at said bottom surface and facing the dead air space in a configuration such that heat applied to the heat insulation tile is reflected by the heat reflective material into the dead air space and the change of temperature in said box tends to change the phase change material to another phase, and the heat insulation value of the heat insulation tile is greater when the heat flow is downward than when the heat flow is upward, and the change of phase of the phase change material is faster when heat flow through the box is upward than when heat flow through the box is downward.

26. The heat insulation tile of claim 25, wherein said phase change material is retained in a bubble pack.

27. The heat insulation tile of claim 25, wherein the insulation box is formed of a material selected from: molded polystyrene, molded cellulose pulp, cardboard, and other heat insulation materials that are durable, light weight, and mildew resistant.

28. The heat insulation tile of claim 25, wherein the phase change material is selected from materials that change between solid and liquid in a temperature range between 60 degrees and 90 degrees F.

29. A ceiling structure formed with heat insulation tiles as described in claim 25.

* * * * *